US007562646B2

(12) United States Patent
Seko et al.

(10) Patent No.: US 7,562,646 B2
(45) Date of Patent: Jul. 21, 2009

(54) AIR-INTAKE DEVICE FOR INTERNAL COMBUSTION ENGINE HAVING NOISE REDUCTION MECHANISM

(75) Inventors: Naohito Seko, Kariya (JP); Kazuhiro Hayashi, Nishikamo-gun (JP); Naoya Katoh, Ama-gun (JP); Makoto Otsubo, Anjo (JP)

(73) Assignee: Denso Corporation, Aichi-pref. (JP)

( * ) Notice: Subject to any disclaimer, the term of this patent is extended or adjusted under 35 U.S.C. 154(b) by 133 days.

(21) Appl. No.: 11/783,965

(22) Filed: Apr. 13, 2007

(65) Prior Publication Data

US 2008/0017156 A1 Jan. 24, 2008

(30) Foreign Application Priority Data

Jul. 21, 2006 (JP) ..... 2006-199180

(51) Int. Cl.
*F02M 35/12* (2006.01)
*F02M 35/10* (2006.01)
*G10K 13/00* (2006.01)

(52) U.S. Cl. ..... 123/184.57; 123/184.47; 123/184.53; 181/160; 181/229

(58) Field of Classification Search ..... 123/184.47, 123/184.53, 184.57; 181/160, 198, 212, 181/214, 229

See application file for complete search history.

(56) References Cited

U.S. PATENT DOCUMENTS 7,350,496 B2 * 4/2008 Nakayama et al. ..... 123/184.57
2006/0065479 A1 * 3/2006 Okawa et al. ..... 181/250

FOREIGN PATENT DOCUMENTS

JP 2004-293365 10/2004

OTHER PUBLICATIONS

U.S. Appl. No. 11/653,357, filed Jan. 2007, Nakayama et al., Counterpart of JP 2006-5676.

* cited by examiner

*Primary Examiner*—Michael Cuff
*Assistant Examiner*—Ka Chun Leung
(74) *Attorney, Agent, or Firm*—Nixon & Vanderhye PC

(57) ABSTRACT

An air-intake device having a noise reduction mechanism includes a surge tank connected to an intake manifold for introducing intake air into an internal combustion engine, an air duct connected to an upstream end of the surge tank and a resonator connected to the surge tank and the air duct. The resonator forms a resonator chamber connected to both the surge tank and the air duct. The surge tank is separated from the resonator chamber by a first vibrating member, and the air duct is separated from the resonator chamber by a second vibrating member. The noises in the surge tank are offset or reduced by resonating vibrations of the first vibrating member, and the noises in the air duct are offset or reduced by resonating vibrations of the second vibrating member. Thus, the intake air noises are effectively reduced by a simple combination of the resonator and the vibrating members.

6 Claims, 6 Drawing Sheets

AIR-INTAKE DEVICE FOR INTERNAL COMBUSTION ENGINE HAVING NOISE REDUCTION MECHANISM

CROSS-REFERENCE TO RELATED APPLICATION

This application is based upon and claims benefit of priority of Japanese Patent Application No. 2006-199180 filed on Jul. 21, 2006, the content of which is incorporated herein by reference.

BACKGROUND OF THE INVENTION

1. Field of the Invention

The present invention relates to an air-intake device for an internal combustion engine, the device having a mechanism for reducing noises generated in a combustion chamber and propagated outside through the air-intake device.

2. Description of Related Art

An example of a device for reducing engine noises is disclosed in JP-A-2004-293365. The device includes a resonator attached to an intake air passage. A vibrating member is disposed at a boundary between the resonator and the intake air passage. The vibrating member is vibrated by sound pressure generated in a combustion chamber and propagated to the intake air passage. It is designed to offset the sound propagating through the intake air passage by vibrations of the vibrating member.

In this device, vibration frequencies of the vibrating member are adjusted by pushing the vibrating member with a stick so that noises desired to be eliminated are canceled by the vibrations of the vibrating member. However, an actuator for driving the stick has to be provided in this device, and it is difficult to precisely adjust the vibration frequencies of the vibrating member. In addition, the frequencies of the noises offset by the vibrating member vary depending on positions of the vibrating member in the air-intake passage.

SUMMARY OF THE INVENTION

The present invention has been made in view of the above-mentioned problem, and an object of the present invention is to provide an improved air-intake device for an internal combustion engine, in which noises having plural frequencies are canceled without using an actuator.

The air-intake device according to the present invention includes a first air passage for introducing intake air into combustion chambers of an internal combustion engine, a second air passage connected to an upstream portion of the first air passage, and a resonator connected to the first and the second air passages. Intake air introduced from outside through an air cleaner is supplied to the internal combustion engine through the second air passage and the first air passage. The resonator forms a common space commonly connected to the first and the second air passages. A first vibrating member is disposed to separate the first air passage from the common space, and a second vibrating member is disposed to separate the second air passage from the common space.

The first air passage may be formed by a surge tank connected to an intake manifold for supplying intake air to each combustion chamber of the internal combustion engine. The second air passage may be formed by a duct having a cross-section smaller than that of the surge tank. The first vibrating member is designed to resonate with a frequency of noises generated in the combustion chamber and propagated to the first air passage, so that an amount of the noises is reduced (offset) by vibrations of the first vibrating member. Similarly, the second vibrating member is designed to resonate with a frequency of noises generated in the combustion engine and propagated to the second air passage through the first air passage, so that an amount of the noises is reduced (offset) by vibrations of the second vibrating member.

The resonator may be disposed around the duct forming the second air passage, so that a resonator space is formed around the second air passage. Plural vibrating members may be installed in the duct to separate the second air passage from the resonator chamber.

According to the present invention, noises having plural frequencies are canceled or reduced by a resonator having two or more vibrating members. No actuator for controlling resonant frequencies of the vibrating member is necessary, and only one common resonator is used. Accordingly, the air-intake device having a noise reduction mechanism can be made compact and at a low cost. Other objects and features of the present invention will become more readily apparent from a better understanding of the preferred embodiments described below with reference to the following drawings.

BRIEF DESCRIPTION OF THE DRAWINGS

FIG. 2(*b*) is a graph showing analysis results of the sound in the air-intake device;

DETAILED DESCRIPTION OF THE PREFERRED EMBODIMENTS

Figure 1:
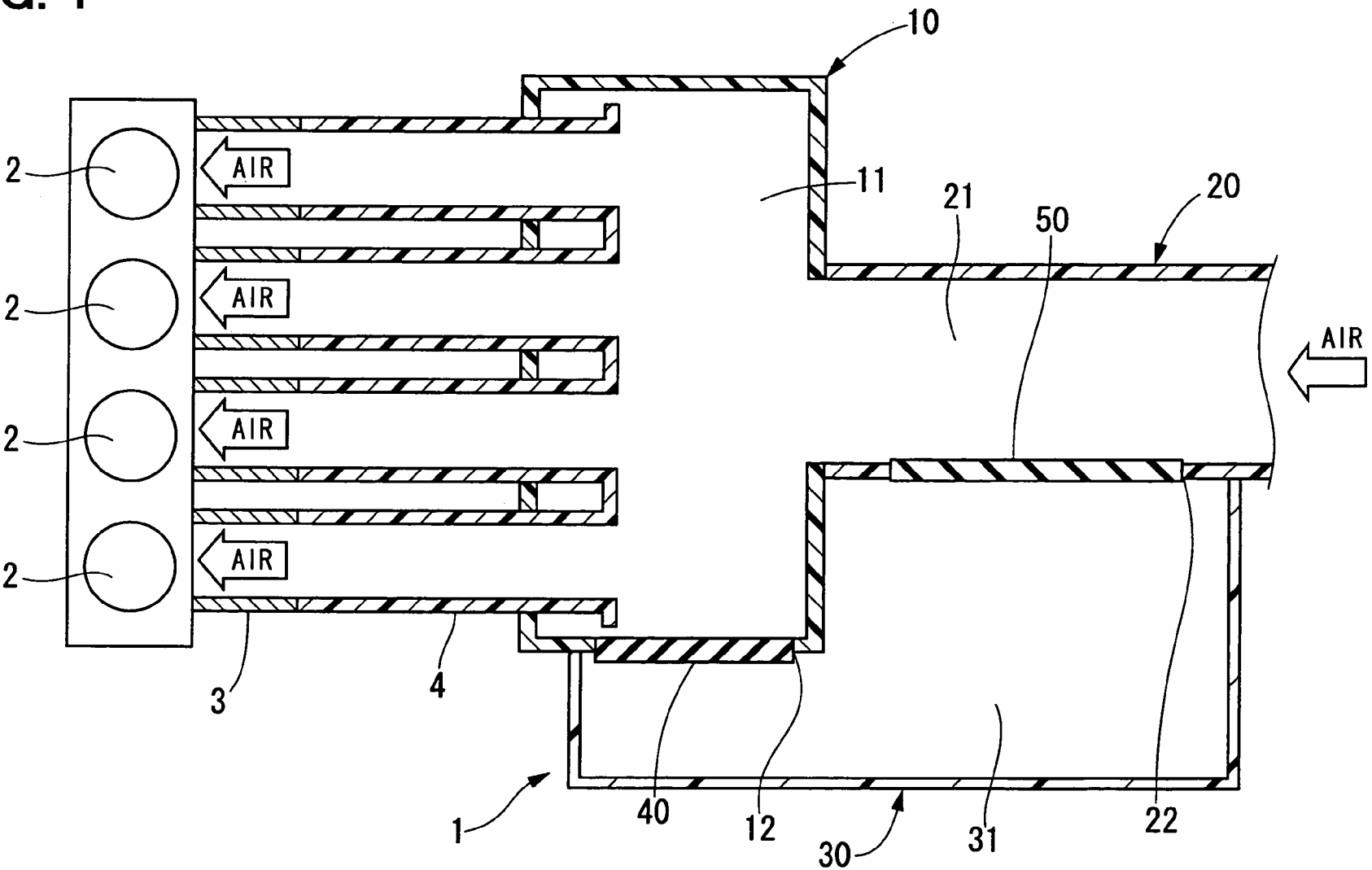
FIG. 1 is a cross-sectional view showing an air-intake device having a noise reduction mechanism, as a first embodiment of the present invention.

A first embodiment of the present invention will be described with reference to FIGS. 1-4. First, with reference to FIG. 1, an entire structure of the air-intake device 1 having a noise reduction mechanism will be described. The air-intake device 1 includes a surge tank 10 forming a first air passage 11 therein, a duct 20 forming a second air passage 21 therein, a resonator 30 forming a common space 31, a first vibrating member 40 and a second vibrating member 50. The surge tank 10, the duct 20 and the resonator 30 are made of a resin material, and first vibrating member 40 and the second vibrating member 50 may be made of a resilient member such as rubber or elastomer rubber. In this particular embodiment, the vibrating members 40, 50 are made of silicone rubber (e.g., fluorosilicone rubber).

An intake manifold 4 made of resin is connected to each intake port that introduces air into each combustion chamber 2 of an internal combustion engine. An amount of intake air passing through the intake manifold 4 is controlled by a throttle valve (not shown). In this particular embodiment, the throttle valve is disposed upstream of the surge tank 10. The surge tank 10 is connected to an upstream portion of the intake manifold 4. In the surge tank 10, a first air passage 11 is formed. The surge tank 10 enlarges the intake air passage to thereby bring an air pressure therein closer to the atmospheric pressure. As a result, a pressure difference relative to a negative pressure in the combustion chamber 2 can be increased thereby to supply a sufficient amount of intake air to the combustion chamber 2.

A duct 20 is connected to an upstream portion of the surge tank 10. The duct 20 forms a second air passage 21 therein. A cross-sectional area of the duct 21 is smaller than that of the surge tank 10. An air cleaner (not shown) for removing foreign particles or dusts included in air is disposed upstream of the duct 20.

A resonator 30 forming a common space 31 is connected to both of the surge tank 10 and the duct 20. The surge tank 10 has a first opening 12 communicating with the common space 31, and the first opening 12 is closed with a first vibrating member 40. The duct 20 has a second opening 22 communicating with the common space 31, and the second opening 22 is closed with a second vibrating member 50. The common space 31 is a space formed in the resonator 30 and closed with the first vibrating member 40 and the second vibrating member 50.

The first vibrating member 40 is vibrated (in an up-down direction in FIG. 1) by sound pressure generated in the combustion chamber 2 and propagated to the first air passage 11. Since the common space 31 is a closed space, the vibration of the first vibrating member 40 is a spring-mass-type vibration, making air in the common space 31 as an air spring. The second vibrating member 50 is vibrated (in an up-down direction in FIG. 1) by sound pressure generated in the combustion chamber 2 and propagated to the second air passage 21. Since the common space 31 is a closed space, the vibration of the second vibrating member 50 is also a spring-mass-type vibration, making air in the common space 31 as an air spring. Both of the first and the second vibrating members 40, 50 are formed in a round disk shape and closely installed in the respective openings 12, 22.

Figure 2:
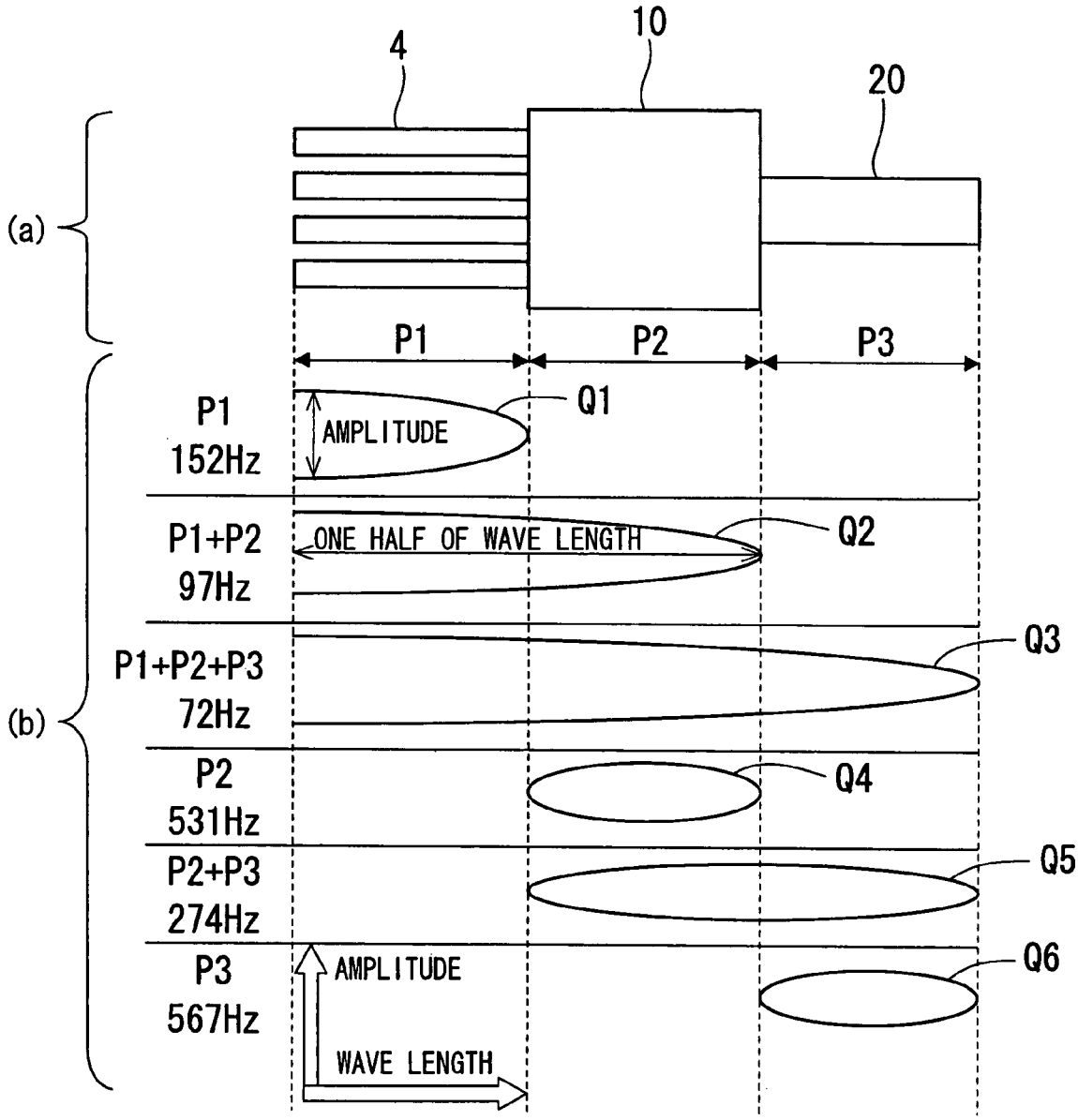
FIG. 2(*a*) is a schematic view showing a model used for analyzing sounds in the air-intake device.

Sound characteristics in an air-intake device composed of the intake manifold 4, the surge tank 10 and duct 20 are analyzed, using a model shown in FIG. 2(*a*). P1 is a model of the air passage in the intake manifold 4, P2 is a model of the air passage in the surge tank 10 and P3 is a model in the duct 20. The length of P1 is 560 mm, the length of P2 is 320 mm, and the length of P3 is 300 mm. In the analysis, both of the first and the second openings 12, 22 are closed. Sound spectra are calculated when noises generated in the combustion chamber 2 and propagated to the intake manifold 4, the surge tank 10 and the duct 20.

FIG. 2(*b*) shows respective sound spectra in the passage P1, P2 and P3. In respective graphs of FIG. 2(*b*), a wavelength of the sound (noise) wave is shown on the abscissa, and its amplitude is shown on the ordinate. A sound wave Q1: one half of its wavelength is 560 mm which is equal to the passage length P1, and its frequency is 152 Hz. A sound wave Q2: one half of its wavelength is 880 mm which is equal to the passage length (P1+P2), and its frequency is 97 Hz. A sound wave Q3: one half of its wavelength is 1180 mm which is equal to the passage length (P1+P2+P3), and its frequency is 72 Hz. A sound wave Q4: one half of its wavelength is 160 mm which is equal to one half of the passage length P2, and its frequency is 531 Hz. A sound wave Q5: one half of its wavelength is 310 mm which is equal to one half of the passage length (P2+P3), and its frequency is 274 Hz. A sound wave Q6: one half of its wavelength is 150 mm which is equal to one half of the passage length P3, and its frequency is 567 Hz. The sound wave Q2 is generated by resonance of Q1 and Q4, the sound wave Q3 is generated by resonance of Q1, Q4 and Q6, and the sound wave Q5 is generated by resonance of Q4 and Q6.

Figure 3:
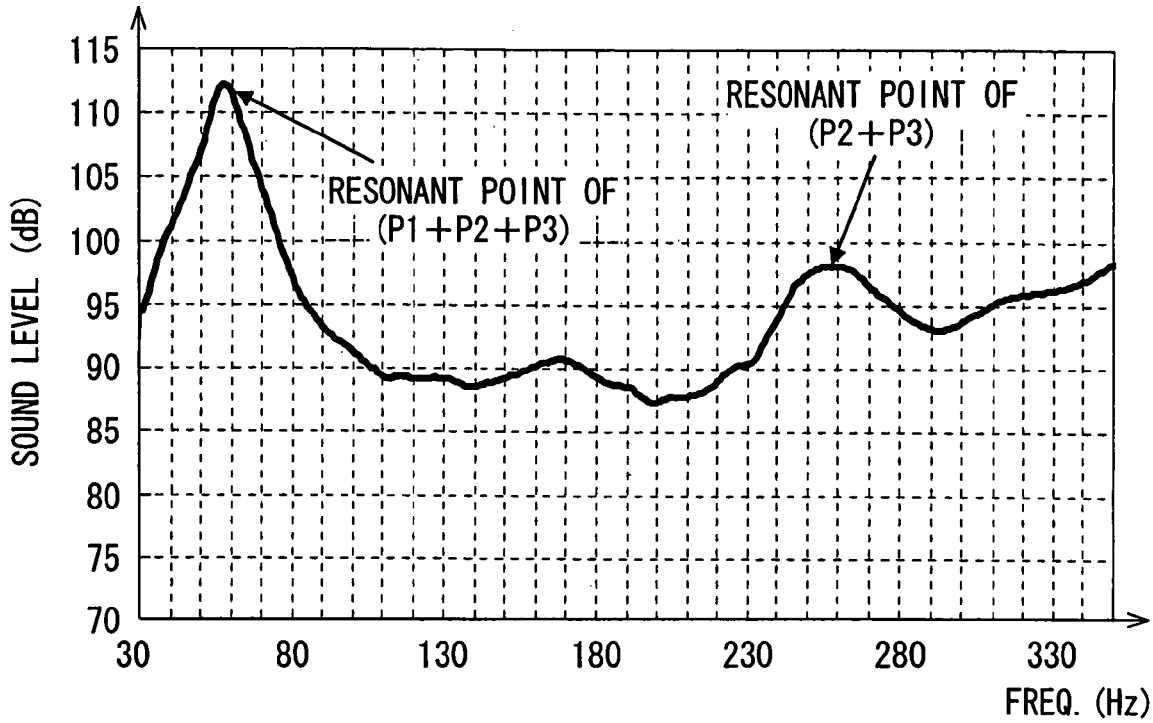
FIG. 3 is a graph showing results of tests for measuring sound levels in a first embodiment of the present invention.

FIG. 3 shows test results which are obtained by actually measuring sound levels (on the ordinate) versus frequencies (on the abscissa) in the embodiment of the present invention shown in FIG. 1. In this test, however, the first and the second openings 12, 22 are closed without installing the vibrating members 40, 50. The levels of the sound generated in the combustion chamber 2 and propagated through the intake manifold 4, the surge tank 10 and the duct 20 are measured.

In the graphs shown in FIG. 3, two peaks of the sound level appear in a neighborhood of 72 Hz (corresponding to the frequency of Q3 in the analysis mentioned above) and in a neighborhood of 274 Hz (corresponding to the frequency of Q5 in the analysis). Accordingly, the sounds (noises) generated in the combustion chamber 2 and propagated through the air passages can be effectively reduced by providing vibrating members 40, 50 in the resonator to offset (cancel) the sound waves Q3 and Q5.

For effectively canceling any of the sound waves Q1-Q6, it is desirable to place a vibrating member at a position where its amplitude is the highest. In this respect, to cancel the sound wave Q3, it is desirable to place a vibrating member in the intake manifold 4 (refer to FIG. 2(*b*)). However, it is difficult to provide a resonator and a vibrating member in the intake manifold 4 because the intake manifold 4 is branched out toward the intake port 3 of each combustion chamber 2. Therefore, the first vibrating member 40 is installed to the surge tank 10 in the first embodiment, taking into consideration the analysis results shown in FIG. 2(*a*) and the test results shown in FIG. 3. By positioning the first vibrating member 40 in the surge tank 10, the sound wave Q3 is considerably canceled, and the sound waves Q2, Q4 and Q5 are also canceled to a certain degree. Similarly, to cancel the sound waves Q3, Q5, and Q6, (especially Q6), the second vibrating member 50 is installed in the duct 20 forming the second passage 21.

An amount of noise reduction obtained by using the first vibrating member 40 or the second vibrating member 50, or both members will be described with reference to FIG. 4. The test has been conducted in the following manner. A speaker is disposed at a downstream end (at an end connected to the intake port 3) of the intake manifold 4, and a microphone is disposed at an upstream end of the second air passage 21. Sounds are outputted from the speaker, changing frequencies thereof in a range from 30 Hz to 400 Hz, and the sounds propagated through the intake manifold 4, the surge tank 10 and the duct 20 are detected by the microphone. An amount of the noise (sound) level reduced in the course of propagation for each frequency is calculated by subtracting the noise level detected by the microphone from the noise level outputted from the speaker.

Figure 4:
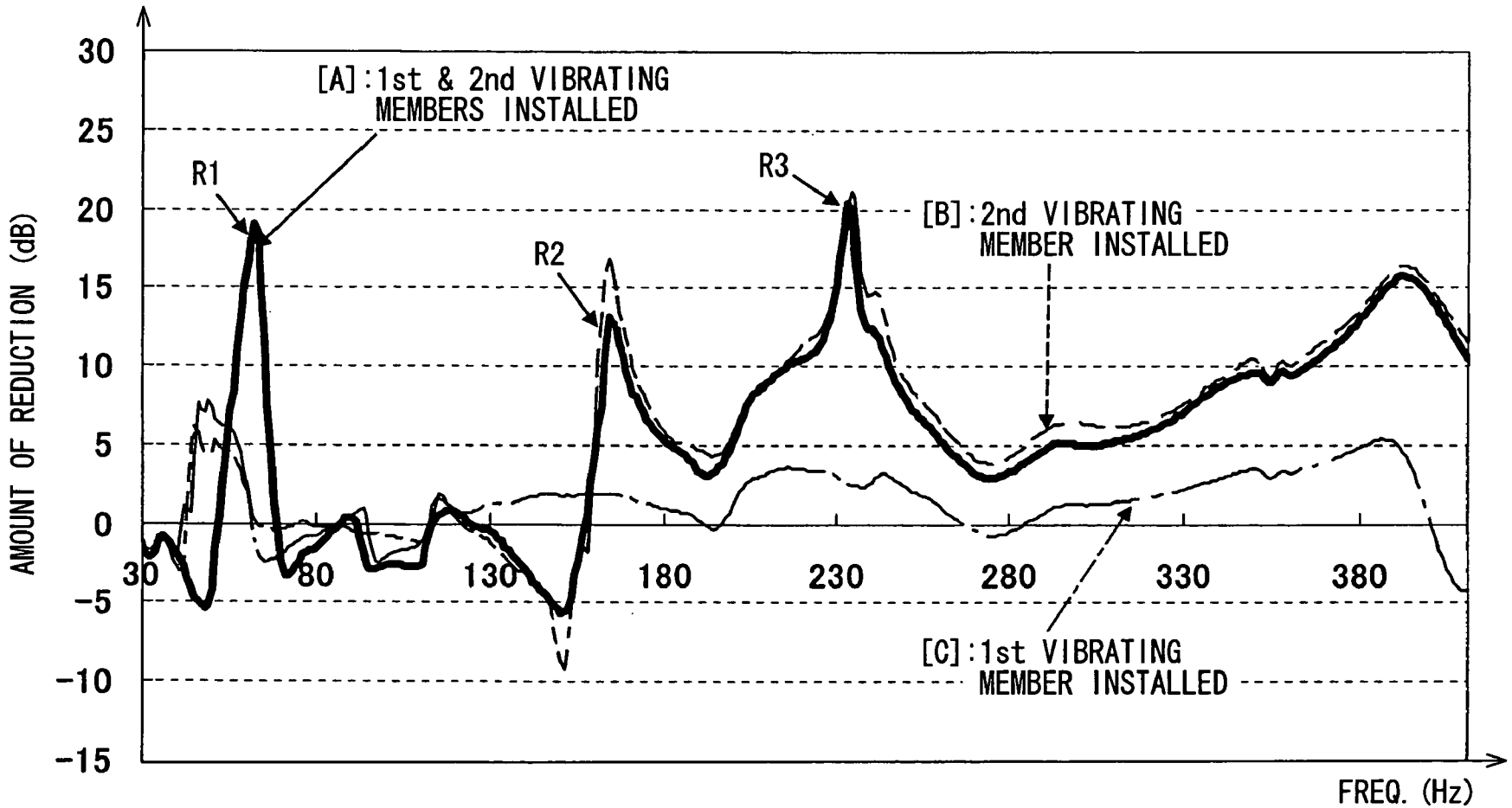
FIG. 4 is a graph showing results of tests for measuring an amount of noise reduction in the first embodiment of the present invention.

In FIG. 4, the reduction amounts in the noise levels (dB) are shown on the ordinate, and frequencies (Hz) are shown on the abscissa. In the graph: a solid line [A] shows the reduction amounts obtained in the first embodiment of the present invention (i.e., both vibrating members 40, 50 are installed); a dotted line [B] shows the reduction amounts obtained in a sample having only the second vibrating member 50 installed in the duct 20 (the first opening 12 is closed); and another dotted line [C] shows the reduction amount obtained in a sample having only the first vibrating member 40 installed in the surge tank 10 (the second opening 22 is closed).

It is seen from the graph that both effects of the first vibrating member 40 (line [C]) and the second vibrating member 50 (line [B]) are combined when both vibrating members 40, 50 are used (line [A]). It is also seen from the graph that the sound wave Q3 (shown in FIG. 2(*b*)) is canceled at the peak R1, the sound wave Q1 is canceled at the peak R2, and the sound wave Q5 is canceled at the peak R3.

In the case, where the frequency of the sound wave Q3 is most effectively canceled in the first air passage 11 and the frequency of the sound wave Q6 is most effectively canceled in the second air passage 21, the first vibrating member 40 is designed to resonate with the frequency of Q3, and the second vibrating member 50 is designed to resonate with the frequency of Q6. In this manner, sound waves having respectively different frequencies are effectively canceled or offset.

The resonator 30 forms the space 31 common to both vibrating members 40, 50. Therefore, the structure of the noise reduction mechanism is simplified and can be made compact. Further, an actuator for changing the resonant frequency of the vibrating member, which is used in a conventional mechanism, is not used in the present invention. Accordingly, the noise reduction mechanism is further simplified, and resonant frequencies of the vibrating members can be precisely set.

Figure 5:
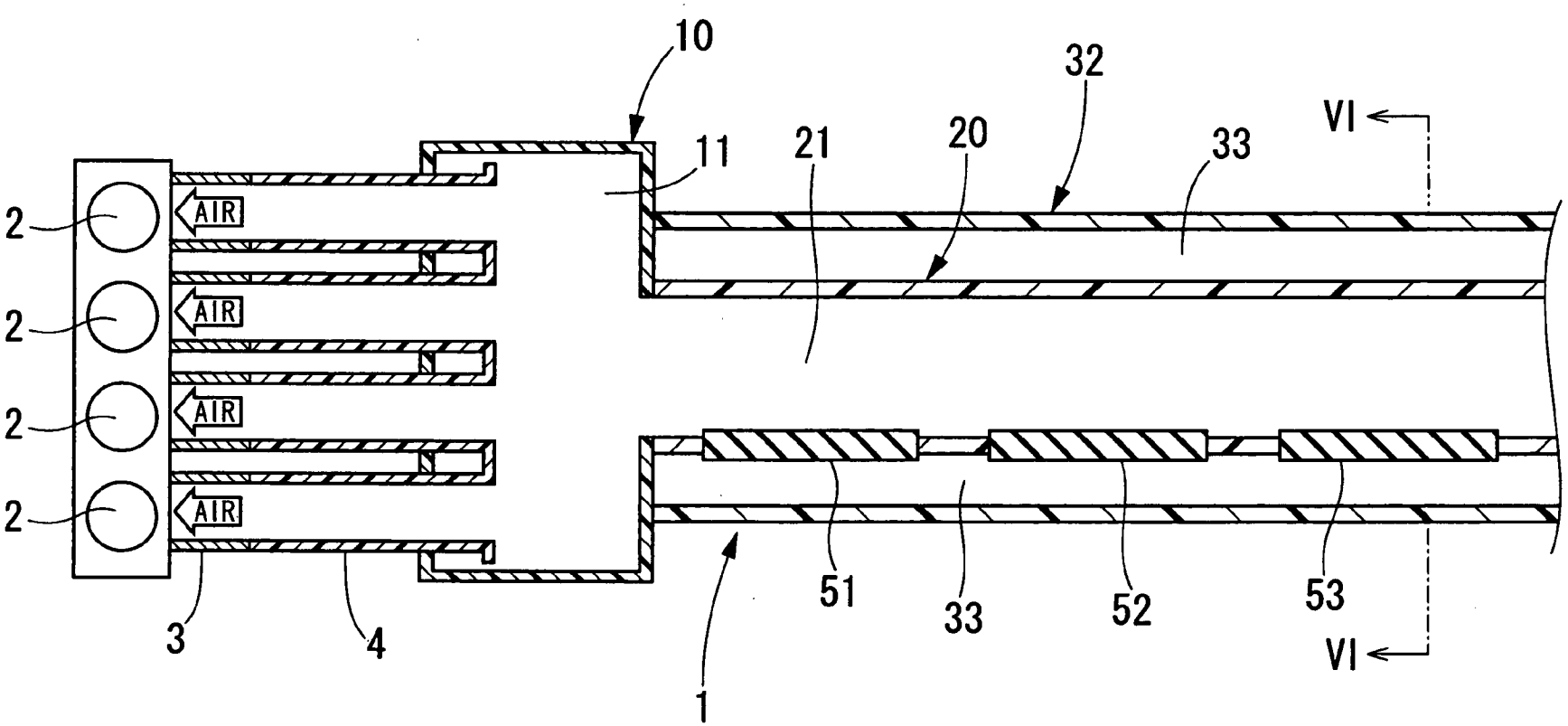
FIG. 5 is a cross-sectional view showing an air-intake device having a noise reduction mechanism, as a second embodiment of the present invention.
Figure 6:
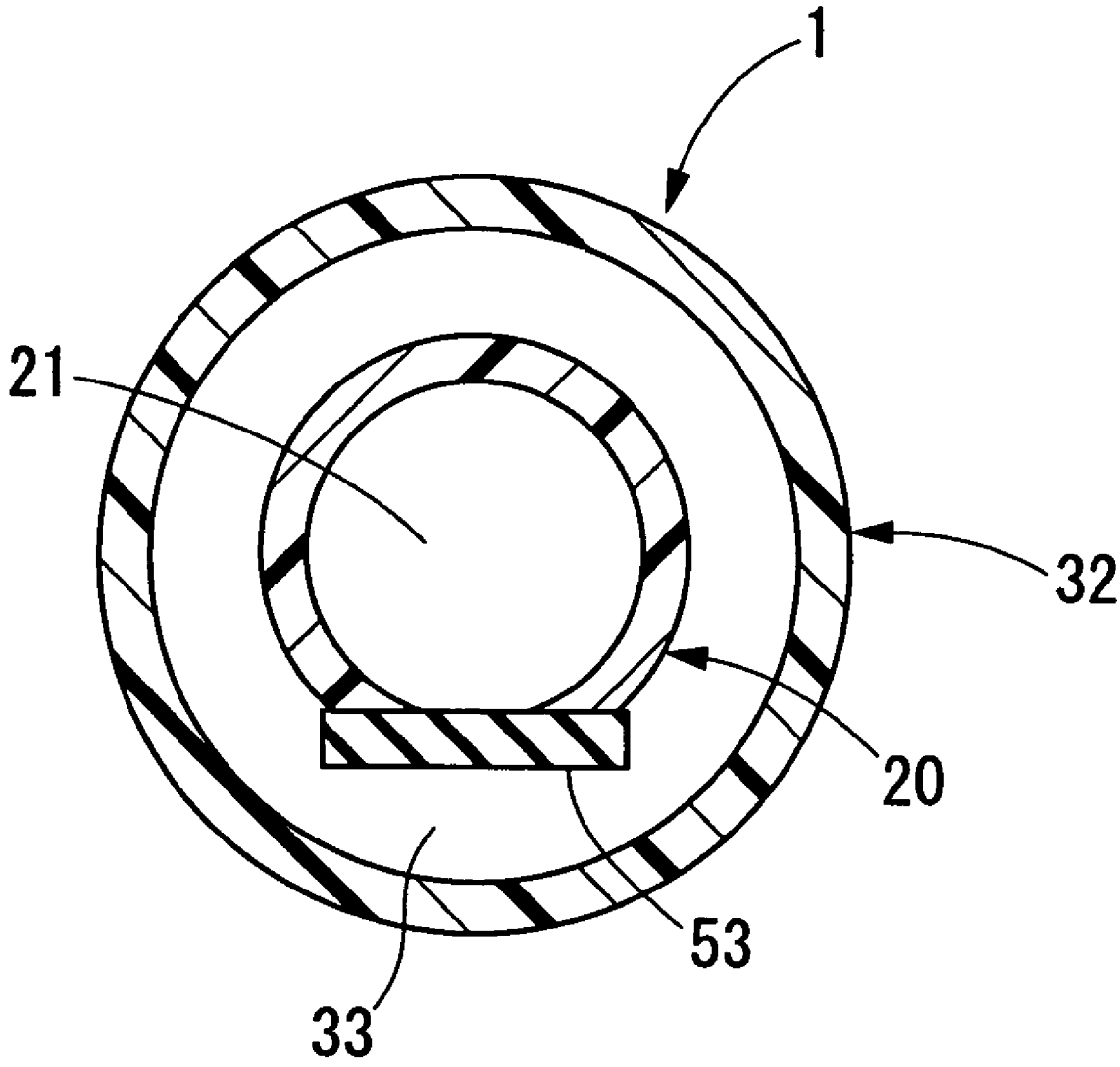
FIG. 6 is a cross-sectional view showing the air-intake device, taken along line VI-VI shown in FIG. 5.

A second embodiment of the present invention will be described with reference to FIGS. 5 and 6. In this embodiment, a resonator 32 forming a closed resonator space 33 is disposed around the duct 20. Accordingly, the resonator space 33 is formed coaxially with the second air passage 21 formed by the duct 20. Three vibrating members 51, 52 and 53 are installed in the duct 20. Since the resonator space 33 is common to three vibrating members, the noise reduction mechanism can be made in a simple form.

The present invention is not limited to the embodiments describe above, but it may be variously modified. For example, the vibrating member or members may be installed in the air cleaner disposed upstream of the duct 20. Plural vibrating members maybe installed in the surge tank 10. While the present invention has been shown and described with reference to the foregoing preferred embodiments, it will be apparent to those skilled in the art that changes in form and detail may be made therein without departing from the scope of the invention as defined in the appended claims.

What is claimed is:

1. An air-intake device for an internal combustion engine, comprising:

a first air passage for introducing intake air into a combustion chamber of the internal combustion engine;

a second air passage positioned upstream of the first air passage;

a resonator forming a common space connected to both of the first air passage and the second air passage;

a first vibrating member disposed to separate the first air passage from the common space, the first vibrating member being vibrated by a sound pressure generated in the combustion chamber and propagated to the first air passage; and a second vibrating member disposed to separate the second air passage from the common space, the second vibrating member being vibrated by a sound pressure generated in the combustion chamber and propagated to the second air passage through the first air passage.

2. The air-intake device as in claim 1, wherein:

the first air passage is formed by a surge tank connected to an intake manifold for supplying intake air to each combustion chamber of the internal combustion engine.

3. The air-intake device as in claim 2, wherein:

the second air passage is formed by a duct disposed upstream of the surge tank and connected thereto, the duct having a passage cross-section smaller than that of the surge tank.

4. The air-intake device as in claim 3, the resonator is formed around the second air passage.

5. The air-intake device as in claim 1, wherein:

the resonator is formed in a circular form surrounding a centerline of intake airflow.

6. The air-intake device as in claim 1, wherein:

the first and the second vibrating members are formed in a circular disk shape.

* * * * *